US010487622B2

(12) United States Patent
Nickles et al.

(10) Patent No.: US 10,487,622 B2
(45) Date of Patent: Nov. 26, 2019

(54) LOCK RING HOLD OPEN DEVICE FOR FRAC SLEEVE

(71) Applicant: BAKER HUGHES, A GE COMPANY, Houston, TX (US)

(72) Inventors: James T. Nickles, Katy, TX (US); James S. Sanchez, Tomball, TX (US); Wara C. Bocangel, Oklahoma City, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 261 days.

(21) Appl. No.: 15/499,214

(22) Filed: Apr. 27, 2017

(65) Prior Publication Data

US 2018/0313190 A1 Nov. 1, 2018

(51) Int. Cl.

| | |
|---|---|
| ***E21B 34/10*** | (2006.01) |
| *E21B 43/26* | (2006.01) |
| *E21B 34/00* | (2006.01) |

(52) U.S. Cl.

CPC ..... *E21B 34/102* (2013.01); *E21B 43/26* (2013.01); *E21B 2034/007* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,607,019 | A * | 3/1997 | Kent | E21B 33/038 166/344 |
| 5,706,894 | A | 1/1998 | Hawkins, III | |
| 7,455,118 | B2 | 11/2008 | Roberts et al. | |
| 8,220,555 | B1 | 7/2012 | Wintill et al. | |
| 8,267,178 | B1 * | 9/2012 | Sommers | E21B 34/102 166/334.4 |
| 8,272,443 | B2 | 9/2012 | Watson et al. | |
| 8,915,300 | B2 | 12/2014 | Sommers et al. | |
| 2005/0121253 | A1 * | 6/2005 | Stewart | G01V 1/52 181/108 |
| 2009/0229828 | A1 * | 9/2009 | Ross | E21B 34/10 166/319 |
| 2009/0283272 | A1 * | 11/2009 | Amaral | E21B 43/2406 166/320 |
| 2012/0031617 | A1 * | 2/2012 | Xu | E21B 21/10 166/305.1 |
| 2013/0248189 | A1 | 9/2013 | Brekke | |
| 2015/0152709 | A1 | 6/2015 | Tough et al. | |
| 2015/0211324 | A1 | 7/2015 | King et al. | |
| 2016/0076337 | A1 * | 3/2016 | Harper | E21B 23/004 166/373 |
| 2016/0290092 | A1 | 10/2016 | Doane et al. | |

* cited by examiner

*Primary Examiner* — David J Bagnell
*Assistant Examiner* — Ronald R Runyan
(74) *Attorney, Agent, or Firm* — Shawn Hunter

(57) ABSTRACT

A lock ring fits into a housing recess defined by a sliding member such as a sleeve. The lock ring is loosely fitted in the recess when the sleeve is in an initial position. The lock ring is preferably smooth on an outer dimension and has a beveled end. The beveled end engages an internal taper in the housing if a force is placed on the sliding sleeve to return it toward the original position. Preferably the shifting of the sleeve to a ports open position places the ratchet on the sleeve in alignment with the lock ring to hold the sliding sleeve locked in the open position.

14 Claims, 1 Drawing Sheet

LOCK RING HOLD OPEN DEVICE FOR FRAC SLEEVE

FIELD OF THE INVENTION

The field of the invention is lockable frac sleeves that lock in the open position with a body lock ring and more particularly where the lock ring has a leading taper to wedge the lock ring into the sleeve should a force on the sleeve urging the sleeve toward the closed position be applied.

BACKGROUND OF THE INVENTION

One frac technique involves an array of sliding sleeve valves that are actuated with dropped balls that get progressively larger as valves are opened in a bottom up direction within an interval of interest. Alternatively, the same size ball can be used to operate multiple sleeves. Each ball lands on a discrete seat to allow pressure to be built above the seated ball and that pressure is used to shift a sleeve to expose a series of frac ports. As each zone is treated in an interval through an open valve that valve is isolated when the next ball that is slightly larger is landed on the next sleeve in an uphole direction and the process is repeated. When the entire interval is treated, the balls and seats are milled out or alternatively production begins.

It is advantageous to hold the already shifted sleeves in the ports open position and in the past this has been done with a lock device. The lock can be used to lock the sleeve in the run in position and when defeated allow the sleeve to shift or the sleeve can have its shifted position locked. Illustrative examples of locking devices for shifting sleeves are: US2015/0152709; U.S. Pat. Nos. 7,455,118: 8,272,443: 8,220,555; US 2016/0290092; US2015/0211324 and US 2013/0248189. More noteworthy is U.S. Pat. No. 8,915,300 which has a protected interior sleeve for a valve so that cementing or treatment which can include debris can occur through the valve and beyond without fouling the track on which the shifting sleeve would then later have to move. The shifting sleeve has a lock ring with ratchets on opposing sides. The lock ring rides with the pressure actuated sleeve after access to the interior sleeve is provided with the breaking of a breakable member. The lock ring travels with the powered sleeve to another set of ratchet teeth which locks the interior sleeve in a shifted position.

The shortcoming of this design is the drift dimension of the innermost sleeve is reduced because the shifting sleeve that is between the outer housing and the inner stationary protective sleeve has to be protected during cementing and thereafter the frac pressure has to penetrate cement that has earlier filled the annulus. The use of a double sided lock ring also adds cost and operational complication to the design.

The present invention retains a shifted frac sleeve in an opened position using a ratchet pattern on the sleeve that comes into engagement with a lock ring that has a facing ratchet pattern as well as a tapered leading end that in the event of a force that would otherwise urge the sliding sleeve back to the closed position creates a wedging action off the surrounding housing that forces the lock ring against the sliding sleeve. The lock ring is loosely retained in a housing recess. After sleeve movement that puts a ratchet pattern in alignment with the lock ring it is movement in the reverse direction that forces the locking ratchet patterns together. These and other aspects of the present invention will be more readily apparent to those skilled in the art from a review of the description of the preferred embodiment and the associated drawing while appreciating that the full scope of the invention is to be determined from the appended claims.

SUMMARY OF THE INVENTION

A lock ring fits into a housing recess defined by a sliding member such as a sleeve. The lock ring is loosely fitted in the recess when the sleeve is in an initial position. The lock ring is preferably smooth on an outer dimension and has a beveled end. The beveled end engages an internal taper in the housing if a force is placed on the sliding sleeve to return it toward the original position. Preferably the shifting of the sleeve to a ports open position places the ratchet on the sleeve in alignment with the lock ring to hold the sliding sleeve locked in the open position.

DETAILED DESCRIPTION OF THE PREFERRED EMBODIMENT

Figures 1, 1A:
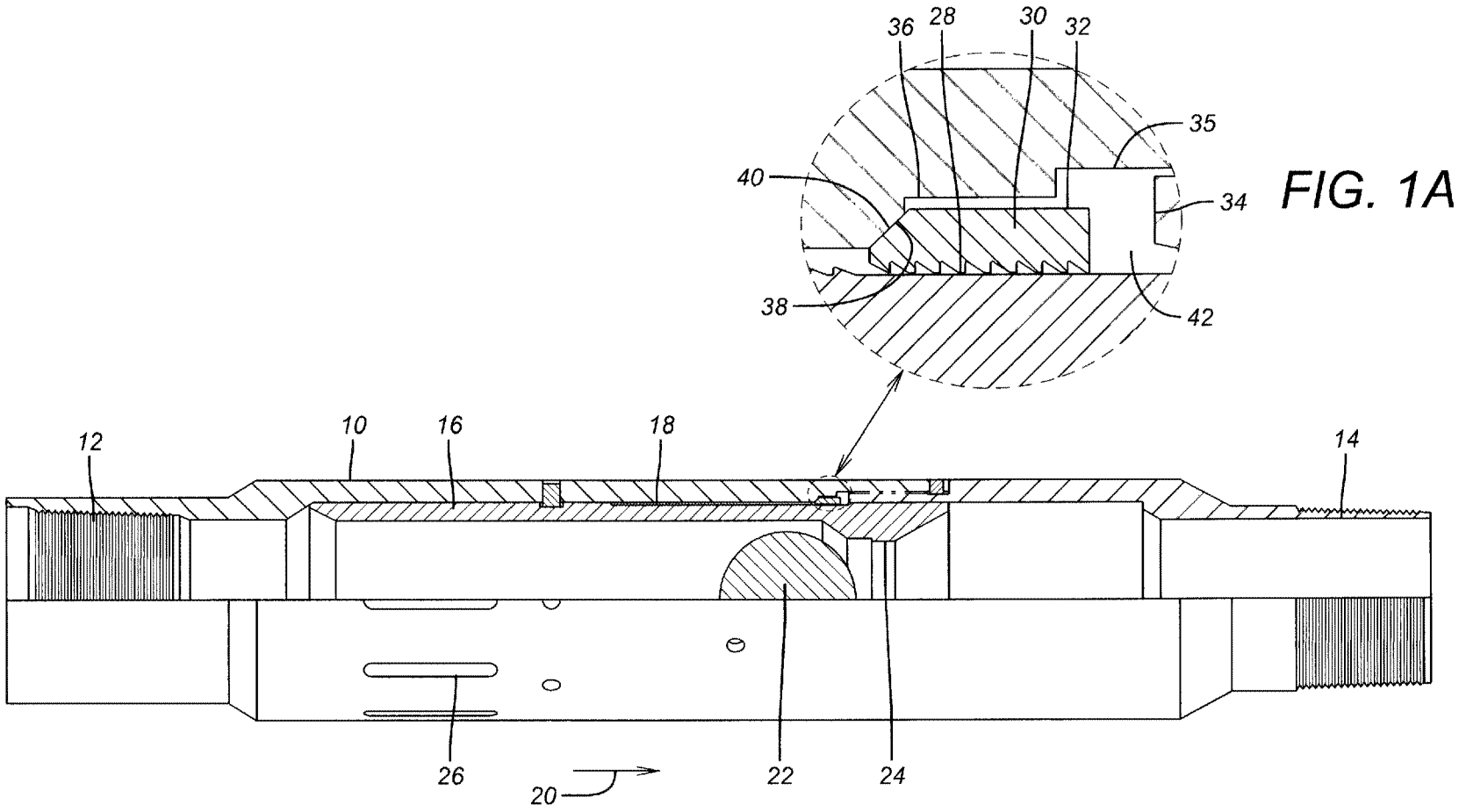
FIG. 1 is a part cutaway section view of the sliding sleeve in the initial closed position.
FIG. 1A is an enlarged view of a portion of FIG. 1.

FIGS. 1 and 1A show a housing 10 with end connections 12 and 14 for connection to similar additional housings in a tubular string that extends from a wellhead that is not shown. A sliding sleeve 16 has an exterior ratchet pattern 18 that permits movement of sleeve 16 in the direction of arrow 20 in response to pressure applied to a landed object such as a ball 22 landed on seat 24. A plurality of openings 26 are initially closed and then opened as sleeve 16 moves in the direction of arrow 20. Such movement also brings the ratchet pattern 18 into axial alignment with ratchet pattern 28 on an inside surface of lock ring 30. The outer surface 32 is smooth and without a ratchetpattern. The mounting of lock ring 30 is initially loose among radial surface 34, cylindrical surfaces 35 and 36 and tapered surface 38. Surface 35 can have a larger diameter than surface 36 to facilitate component assembly but the end of surface 36 is sufficiently close to surface 34 to maintain the lock ring 30 in a generally parallel orientation to the sliding sleeve 16 without enough room for the lock ring 30 to cock toward surface 35 and jam sleeve 16 as it tries to slide in the direction of arrow 20. With sliding sleeve 16 shifted to open the ports 26 the ratchet patterns 18 on the sleeve 16 and 28 on the lock ring 30 can engage but do not necessarily have to be fully engaged. The sliding sleeve 16 is effectively locked as attempted movement of sliding sleeve 16 in a direction opposite arrow 20 will at some point either engage meshing teeth 18 and 28 first or the leading beveled end 40 of the lock ring 30 will first engage beveled surface 38 to urge the meshing teeth 18 and 28 to then get together. Thereafter, movement of sleeve 16 toward a covered ports 26 position will stop as the meshing teeth 18 and 28 will be engaged and the leading taper 40 of lock ring 30 will engage housing taper 38 to end further axial movement of the sliding sleeve 16.

Those skilled in the art will realize that a typical bottom hole assembly in an interval of interest will have multiple housings 10 with seats 24 of different dimensions so that a bottom up treatment of the interval can be accomplished with progressively larger objects such as balls 22. The lock ring 30 can be a loosely mounted complete ring that is fitted into recess 42 defined between the housing 10 and the sliding sleeve 16. Movement of the sleeve 16 in the direction of arrow 20 is enabled by the shape of the ratcheting teeth in the direction of relative movement such that the sleeve 16 can move in the direction of arrow 20 as the meshing ratchet pattern 28 simply jumps away from the ratchet pattern 18 as the sleeve 16 moves in the direction of arrow 20. It is possible that mesh patterns 18 and 28 may not engage with sliding sleeve 16 in the ports 26 open position but as soon as a force is applied to the sleeve 16 in the opposite direction of arrow 20 the wedging action will force the patterns 18 and 28 together if they are not already and if they are it will force them more tightly together. As soon as surfaces 38 and 40 contact there will be a radial force component further pushing the patterns 18 and 28 further together and wedging sleeve 16 against further axial movement toward closing the ports 26.

While the locking system is described in the context of locking a sliding sleeve in the ports open position the lock could serve the opposite function of locking with the ports closed or even in other tools that have relative component movement that then needs to be locked after an initial movement. The loosely fitted lock ring with a single sided locking pattern is cheaper to produce and faster to assemble. The ring can be complete or segmented. The bevel nose on the lock ring jams the ratchet patterns together and stops axial movement. The loose fit of the lock ring lets the meshing ratchet patterns more easily align while promoting unhindered movement in the desired direction as the mesh patterns ride over each other. In another variation the lock ring can be biased in the direction opposite arrow 20 which brings surfaces 38 and 40 together. This bias may be overcome as the sleeve 16 moves in the desired direction but can result in even less movement in the opposite direction before movement lockup.

While the preferred treatment is fracturing, the teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc., all collectively included in a term "treating" as used herein. Another operation can be production from said zone or injection into said zone.

The above description is illustrative of the preferred embodiment and many modifications may be made by those skilled in the art without departing from the invention whose scope is to be determined from the literal and equivalent scope of the claims below:

We claim:

1. An assembly for locking return relative movement between components of a borehole tool after allowing an initial relative movement between components, comprising:

a housing:

a member movably mounted to said housing defining a recess in between, said member comprising a part of a selectively meshing ratchet pattern;

said member comprises a sliding sleeve selectively covering at least one port in a wall of said housing; and a lock ring loosely mounted in said recess and having a cooperatively meshing lock ring ratchet pattern, said lock ring wedging against said housing and said member on an attempt of said return relative movement, said lock ring having a smooth exterior surface opposite said ratchet pattern on an interior surface thereof.

2. The assembly of claim 1, wherein:

said lock ring comprises an end bevel.

3. The assembly of claim 2, wherein:

said end bevel selectively contacting a mating bevel on said housing.

4. The assembly of claim 1, wherein:

said lock ring is guided by said housing to maintain a parallel orientation to said member while loosely mounted in said recess.

5. The assembly of claim 1, wherein:

said sliding sleeve further comprises a structure in a passage therethrough adapted to accept an object thereon for pressure buildup that translates said meshing ratchet pattern parts over each other.

6. The assembly of claim 5, wherein:

said housing comprising a flowpath therethrough in alignment with said passage in said sliding sleeve.

7. The assembly of claim 1, wherein:

said lock ring is continuous for 360 degrees.

8. A treatment method, comprising:

operating at a predetermined location in a borehole an assembly for locking return relative movement between components of a borehole tool after allowing an initial relative movement between said components to open access to a formation, comprising:

a housing comprising at least one port;

a member movably mounted to said housing defining a recess in between, said member comprising a part of a selectively meshing ratchet pattern;

providing a sliding sleeve as said member, said sliding sleeve selectively covering said at least one port in a wall of said housing;

a lock ring loosely mounted in said recess and having a cooperatively meshing lock ring ratchet pattern, said lock ring wedging against said housing and said member on an attempt of said return relative movement;

treating the formation through said at least one port; and locking said member against closing said at least one port.

9. The method of claim 8, comprising:

providing a smooth exterior surface on said lock ring opposite said ratchet pattern on an interior surface thereof.

10. The method of claim 8, comprising:

providing an end bevel on said lock ring.

11. The method of claim 10, comprising:

selectively contacting said end bevel to a mating bevel on said housing.

12. The method of claim 8, comprising:

guiding said lock ring with said housing to maintain a parallel orientation to said member while said lock ring is loosely mounted in said recess.

13. The method of claim 8, comprising:

providing a structure in a passage through said sliding sleeve adapted to accept an object thereon for pressure buildup that translates said meshing ratchet pattern parts over each other.

14. The method of claim 13, comprising:

providing a flowpath through said housing in alignment with said passage in said sliding sleeve.

* * * * *